US009410294B2

(12) United States Patent
Harkness

(10) Patent No.: US 9,410,294 B2
(45) Date of Patent: Aug. 9, 2016

(54) RAILWAY RAIL SUPPORT PLATE

(75) Inventor: Steven Harkness, Wingfield (AU)

(73) Assignee: INTERCAST & FORGE PTY LIMITED, Wingfield, SA (AU)

( * ) Notice: Subject to any disclaimer, the term of this patent is extended or adjusted under 35 U.S.C. 154(b) by 161 days.

(21) Appl. No.: 14/119,907

(22) PCT Filed: May 25, 2012

(86) PCT No.: PCT/AU2012/000587

§ 371 (c)(1),
(2), (4) Date: Mar. 28, 2014

(87) PCT Pub. No.: WO2012/159167

PCT Pub. Date: Nov. 29, 2012

(65) Prior Publication Data

US 2014/0124588 A1 May 8, 2014

(30) Foreign Application Priority Data

May 25, 2011 (AU) ..... 2011902033

(51) Int. Cl.
*E01B 9/40* (2006.01)
*E01B 9/42* (2006.01)

(52) U.S. Cl.
CPC .... *E01B 9/40* (2013.01); *E01B 9/42* (2013.01)

(58) Field of Classification Search
CPC ..... E01B 9/00; E01B 9/02; E01B 9/38; E01B 9/40; E01B 9/42; E01B 9/54
USPC ..... 238/287, 290, 292, 293, 304, 306
See application file for complete search history.

(56) References Cited

U.S. PATENT DOCUMENTS

| | | | | |
|---|---|---|---|---|
| 2,146,341 | A | 2/1939 | Kahn | |
| 2,656,116 | A * | 10/1953 | Protzeller | E01B 9/40 238/283 |
| 6,296,195 | B1 * | 10/2001 | Blank | E01B 9/681 238/2 |
| 6,761,322 | B1 | 7/2004 | Porrill et al. | |
| 2011/0068182 | A1 | 3/2011 | Bosterling et al. | |

FOREIGN PATENT DOCUMENTS

| | | |
|---|---|---|
| GB | 720854 | 12/1954 |
| GB | 1323624 | 7/1973 |
| WO | 9845537 A1 | 10/1998 |
| WO | 2005083178 A1 | 9/2005 |

* cited by examiner

*Primary Examiner* — R. J. McCarry, Jr.
(74) *Attorney, Agent, or Firm* — Klauber & Jackson LLC

(57) ABSTRACT

This invention relates to a support plate for supporting a railway rail on a rail support member, said support plate comprising a lower surface for directly or indirectly contacting a mounting surface of the rail support member, an upper surface for directly or indirectly supporting the rail, and an intermediate region interposing the upper and lower surfaces, for reducing support plate weight.

21 Claims, 14 Drawing Sheets

Section A-A

Section B-B

Section B-B

Section D-D

Section E-E

Section F-F

RAILWAY RAIL SUPPORT PLATE

CROSS REFERENCE TO RELATED APPLICATIONS

The present application is a National Stage Application claiming the priority of co-pending PCT Application No. PCT/AU2012/000587 filed May 25, 2012, which in turn, claims priority from Australian application No. 2011902033, filed May 25, 2011. Applicant claims the benefits of 35 U.S.C. §120 as to the PCT application and priority under 35 U.S.C. §119 as to the said Australian application, and the entire disclosures of both applications are incorporated herein by reference in their entireties.

FIELD OF THE INVENTION

The present invention relates to railway, system construction. More particularly, the present invention relates to support plates that secure a railway rail to a rail support member such as a railway sleeper, concrete base, or the like.

BACKGROUND OF THE INVENTION

Railway systems involve sets of tracks, each track including one or more railway rails. Each rail is secured to support members to form the track over which a train may run. The support members may include a cross member such as a "railway sleeper", or a concrete base, steel support, or the like.

In practice, each rail may be secured to a support member using a support plate which is located between a foot of the rail and a supporting surface of the support member. Such a support plate may include, for example, a "tie plate" or a "turnout plate". In terms of supporting a rail to a railway sleeper, each support plate is fixed to the sleeper using a suitable fixing such as a threaded fastener or spike (large nail), with the actual fixing depending on the sleeper design and material. The rail is then secured to the support plate, and thus to the sleeper, using another fixing, which may include a tie clip. In operation, each sleeper is usually supported by a foundation comprising a ballast material. A sleeper may thus include upper and lower surfaces for contacting a tie plate and ballast respectively.

Railway system construction involves transporting large numbers of components across large distances. Typically the components are transported in high volume containers, such as shipping containers. Such transportation incurs significant transport costs. Indeed, the transportation demands are such that even a slight reduction in component weight can lead to a significant reduction in transportation costs. For example, because some transportation systems are weight restricted, a reduction in the weight of a particular component may mean that a larger number of those components may be transported for a particular weight restriction.

Because of the need for load bearing components, such as the support plate, to meet particular structural demands and provide structural integrity over an extended operational life, a significant challenge in component design involves reducing component weight whilst maintaining the required structural performance.

One approach for reducing the weight of a support plate involves forming a series of grooves or slots on the surface of the support plate in contact with the support member to reduce material mass. Unfortunately, incorporating grooves on the surface of the support plate in contact with the support member may lead to a reduction in the operational life of the support member, at least. For example, as a train moves along a rail and across the railway support member, the support member supports the weight of the train. The train movement may create slight movements and frictional forces between the contacting surfaces of the support plate and the support member. Over time, these frictional forces may contribute to wear of the support plate or the support member, which may ultimately result in the support plate or the support member requiring removal and replacement, thus limiting the operational life. The extent to which the support plate contributes to the frictional forces, and thus the degradation of the support member, depends at least to some extent on the interface between the support plate and the support member.

It is against this background that the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY OF THE INVENTION

In a first aspect the present invention may be said to reside in a support plate for supporting a railway rail on a rail support member, said support plate comprising a lower surface directly or indirectly supported on a mounting surface of the rail support member, an upper surface for directly or indirectly supporting the rail, and an intermediate region interposing the upper and lower surfaces, for reducing support plate weight.

In one form, the support plate further comprises a base comprising the lower surface, a deck disposed above the base and comprising the upper surface, and wherein the intermediate region is interposing and separating the base and the deck.

In one form, the intermediate region is or comprises a hollow region.

This intermediate (and hollow in some cases) region may be so extensive as to largely fill the support plate (or largely render it hollow). Moreover, the intermediate region may be externally visible, or substantially enclosed and therefore mostly, if not completely, concealed.

In one form, the intermediate region comprises one or more support elements for supporting the deck.

In one form, the or each support element extends from the base to the deck.

In one form, the intermediate region is at least partially occupied by a material having different material properties to the deck and the base.

In a further aspect, the invention may be said to reside in a support plate for supporting a railway rail on a support member, said plate including:

- a base including a lower surface for contacting a mounting surface of the support member;
- a deck including an upper surface for supporting a foot of the rail, said deck disposed above the base; and
- an intermediate region interposing the deck and the base, said intermediate region including one or more support elements for supporting the deck.

In one form, the support plate is one of an assembly of plates supporting a rail on a rail support member.

In one form, the support plate may include a tie plate or a turnout plate.

In one form, the support plate is a lowermost or base plate of the assembly.

The support member may include a railway sleeper, a concrete base (such as a concrete slab), or a steel structure.

Embodiments of the present invention may include one or more shoulders which extend upwardly from the base. It is preferred that the shoulders are arranged to locate the foot on the upper surface. In one embodiment, the support plate includes a pair of shoulders where the deck extends between them.

The intermediate region may include a hollow region or a partially hollow region. The intermediate region may include one or more passages which extend through the support plate to allow moisture egress, such as water egress, from the support plate when in use.

In one form, the support elements are configured and arranged to transfer and distribute a load placed on the upper surface to and (optionally) across the base. In one form, each support element extends from the base to the deck.

The support elements may include pillar (or column)-like elements. However, in alternative embodiments the support elements may have other configurations. For example, in one embodiment the support elements include one or more generally longitudinal elements, such as rib-like elements, extending across a horizontal extent of the intermediate region. Other configurations may also be possible.

In an embodiment which includes support elements in the form of pillar-like elements, the pillar-like elements may have substantially the same horizontal cross-section. However, it is not essential that the pillar-like elements have substantially the same horizontal cross-section since in other embodiments it is possible that the pillar-like elements may have a horizontal cross-section which depends on the location within the intermediate region.

The pillar-like elements may include generally cylindrically shaped bodies. This generally cylindrically shaped body may have a diameter of 4 mm upwards, but generally in the range of 4 to 20 mm. Cylindrically shaped pillar-like elements are expected to provide a suitable balance between strength/weight ratio and manufacturing cost. However, other geometries may also be possible, such as, faceted or multi-faceted geometries. Other suitable geometries include diamond shaped, square shaped, or frusto-conical shaped support elements.

The cross section of the pillar-like elements should be large enough to facilitate manufacture and carry the expected load, but small enough to reduce the weight of the support plate whilst providing desired structural characteristics.

In one form, the pillar-like elements are disposed in a substantially uniform arrangement. In other words, the pillar-like elements are substantially uniformly spaced within the intermediate region. However, it is not essential that the pillar-like elements be so disposed since in other embodiments the arrangement of the pillar-like elements may depend on the expected distribution of load across the upper surface so that, for example, there is a greater density of pillar-like elements in areas of higher load. Similarly, the geometry of the pillar-like elements need not be uniform but could instead vary according to the expected load distribution across the upper surface so that, for example, pillar-like elements in areas of higher expected load may have a larger horizontal cross sectional area than those in areas of lower expected load. Optimizing the arrangement and/or geometry of the pillar-like elements according to the expected distribution of load across the upper surface may lead to further weight reductions.

In an embodiment, the intermediate region is at least partially occupied by a material having different material properties to the deck and the base. The material may form a layer between the deck and the base. The material may include at least one of:

a. a rubber composition;
b. plastic;
c. a composite material;
d. metal;
e. concrete;
f. foam; or
g. an epoxy resin based material.
h. sand In some embodiments, the material includes a resilient material which is inserted into the intermediate region to improve the compressive and tensile properties of the support plate.

A support plate in accordance with an embodiment may be manufactured as a one-piece component from a material having suitable mechanical properties using a suitable manufacturing process. One example of a suitable manufacturing process is sand casting. In some embodiments, the support plate is a cast-iron product. However, it is to be appreciated that other manufacturing processes and materials may be used. For example, in other embodiments the tie plate may be a machined, forged, or welded product. Other suitable materials and manufacturing processes would be well within the knowledge of a skilled addressee.

BRIEF DESCRIPTION OF THE DRAWINGS

An illustrative embodiment of the present invention will be discussed with reference to the accompanying drawings wherein.

In the following description, like reference characters designate like or corresponding parts throughout the several views of the drawings.

DESCRIPTION OF ILLUSTRATIVE EMBODIMENT

The drawings in the present application and their accompanying detailed description are directed to merely example embodiments of the invention. To maintain brevity, other embodiments of the invention which use the principles of the invention are not specifically described in the present application and are not specifically illustrated by the present drawings.

The below described embodiment of the present invention relates to a support plate in the form of a tie plate for securing a rail to a rail support member in the form of a sleeper. However, it is to be understood that the present invention is not intended to be limited to tie plates nor to use with a particular type of rail support member. For example, other embodiments of the present invention provide other forms of support plates, such as a turnout plate, or indeed support plates for use with other rail support members, such as in cases where the support plate is one of an assembly of plates supporting a rail on a rail support member, and the support plate is any one of the plates in the assembly.

Accordingly, although the below description relates to a tie plate, it is to be understood that the invention is not to be so limited. It is also to be understood that support plates according to embodiments of the present invention may be used with a variety of rail support members.

Figure 6:
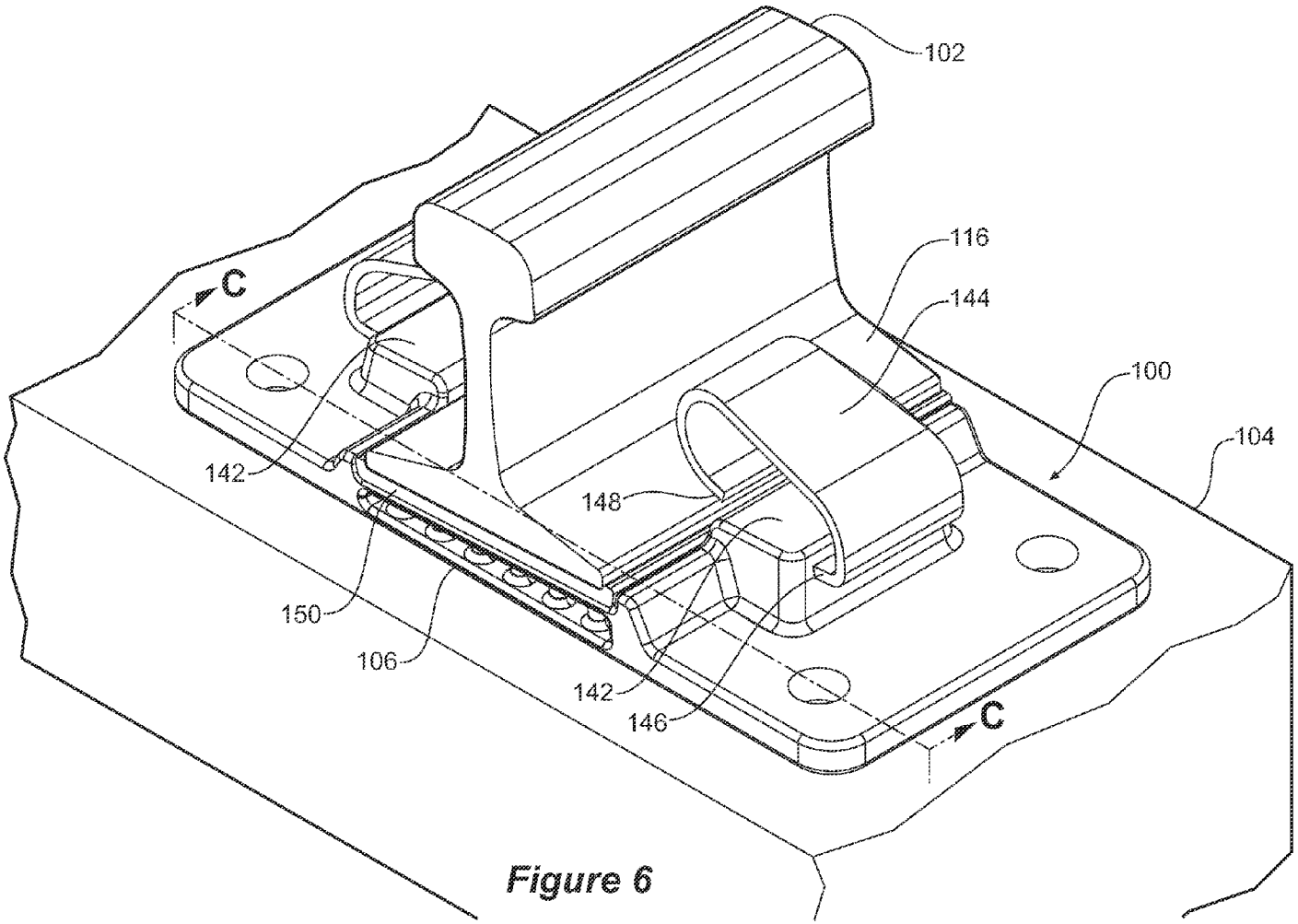
FIG. 6 is top isometric view of the tie plate illustrated in FIG. 1 forming part of an assembly supporting a rail.
Figure 7:
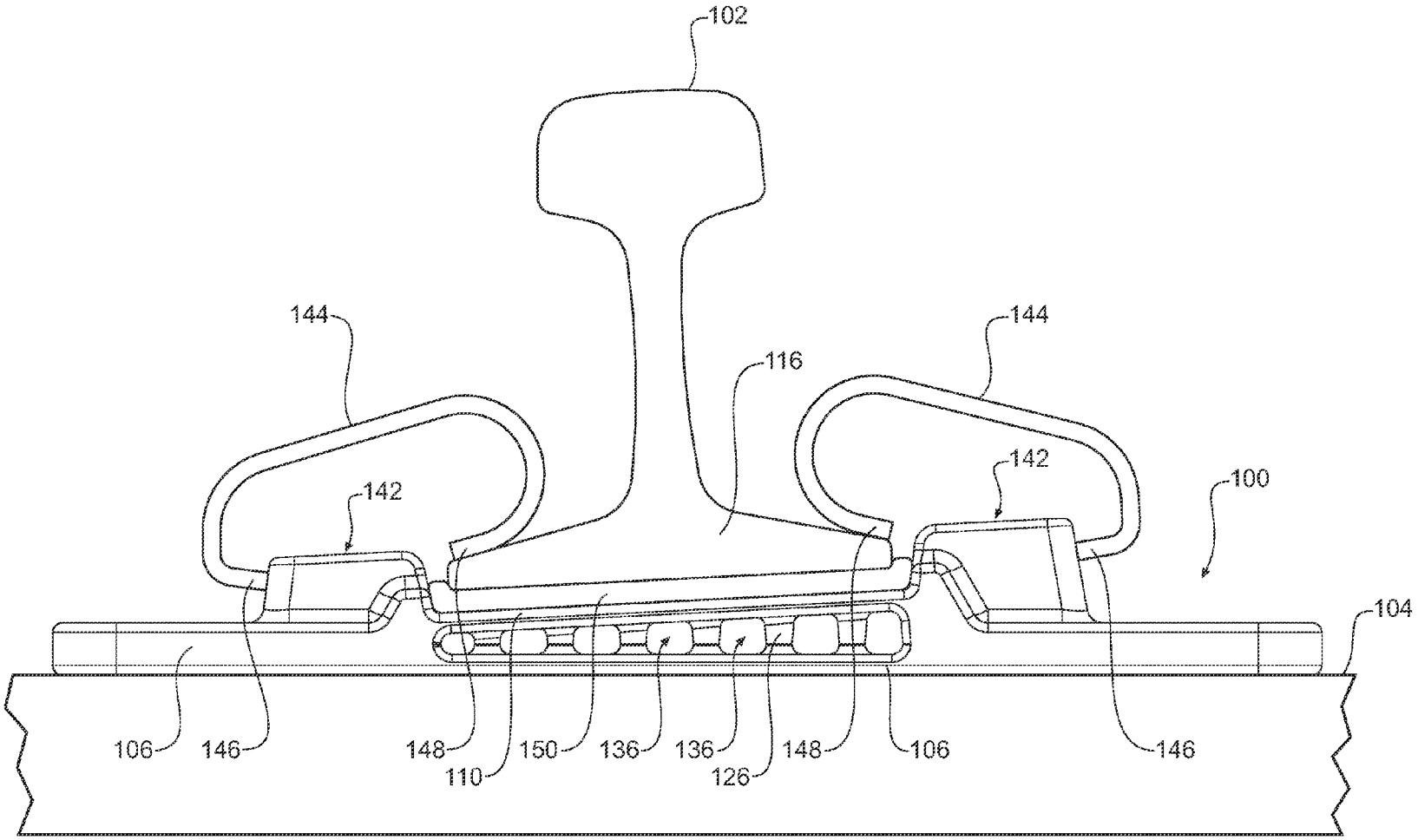
FIG. 7 is an end view of the assembly illustrated in FIG. 6.
Figure 8:
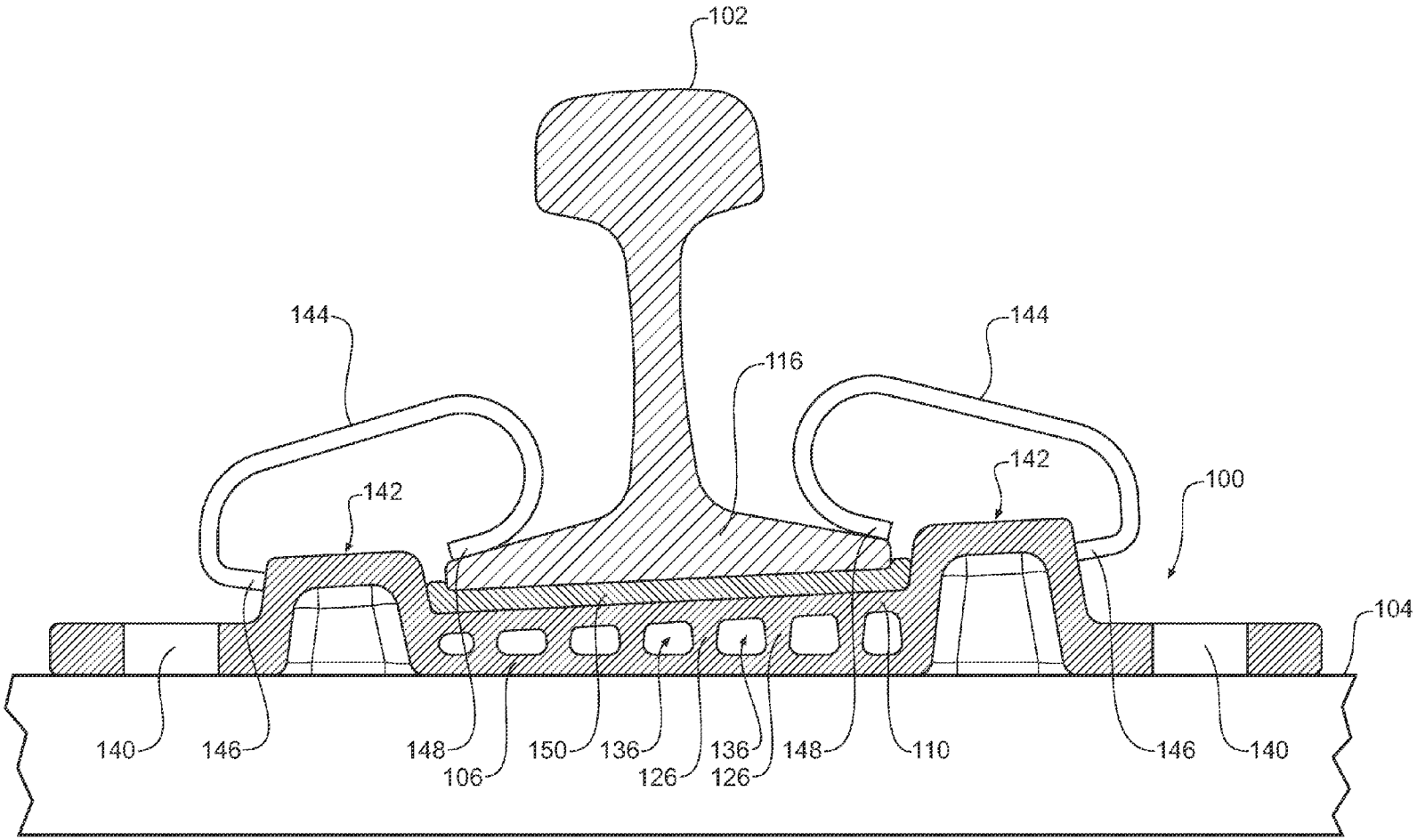
FIG. 8 is a sectional view of the tie plate illustrated in FIG. 6, when sectioned along the line C-C.

FIGS. 1 to 5 illustrate a tie plate 100 according to an embodiment of the present invention. FIGS. 6 through 8 illustrate the tie plate 100 supporting a railway rail 102 on a railway sleeper 104 positioned beneath and in contact with the tie plate 100 to transfer the weight of an over-passing train to the sleeper 104.

The tie plate 100 illustrated in FIGS. 1 to 5 is manufactured from a single piece of metal, such as iron, using a sand casting process. However, it is also possible that the tie plate 100 may be manufactured from other materials, such as rubber, composite, other metals, or indeed any other material sufficient to withstand the load exerted thereon by a train and any other equipment attached or mounted to the tie plate 100 in use. Further, in alternative embodiments, the tie plate 100 may be assembled from separate pieces of material.

The tie plate 100 includes a base 106 and a deck 110 disposed above and spaced apart from the base 106. The base 106 includes a lower surface 112 (shown as a continuous planar surface) for contacting a correspondingly shaped mounting surface of the sleeper 104. The deck 110 includes an upper surface 118 (shown as a continuous planar surface) for supporting a foot 116 of the rail 102, as illustrated in FIGS. 6 through 8. An intermediate region 120 interposes the deck 110 and the base 106.

In the illustrated embodiment this intermediate region 120 is externally visible, but the intermediate region 120 can be concealed "as-cast", or it may be concealed by way of a further manufacturing process, such as by welding a cover plate over any opening to the intermediate region 120.

The illustrated embodiment also includes a pair of shoulders 108, 108' for locating the rail foot 116 on the upper surface 118. In the present case, the shoulders 108, 108' extend upwardly from the base 106 and laterally across the width of the tie plate 100. The shoulders 108, 108' include oppositely facing walls 114, 114' which are spaced apart by substantially the same extent as the width of the rail foot 116 to be located on the upper surface 118. It is to be noted that it is not essential that embodiments of the present invention include shoulders 108, 108' as in some embodiments shoulders may not be required to locate the rail foot 116 on the upper surface 118 of the deck 110. Nonetheless, it is preferred that shoulders 108, 108' be provided. It is to be noted that in embodiments of the present invention which include shoulders, the number, shape and arrangement of the shoulders may be different to shoulders 108, 108'.

Figure 1:
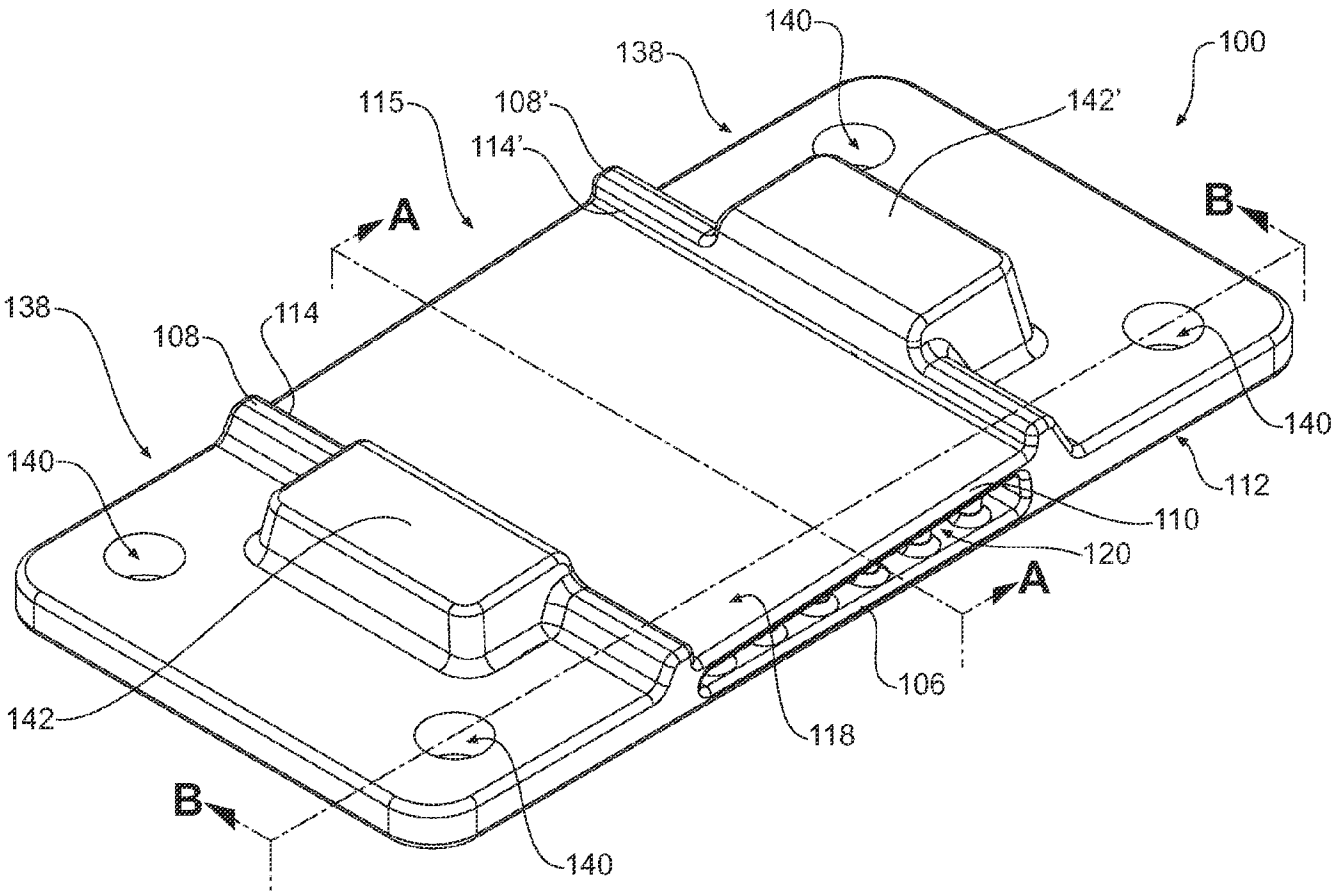
FIG. 1 is a top isometric view of a tie plate according to a first embodiment of the present invention.

As shown in FIG. 1, in the illustrated embodiment the deck 110 extends between the shoulders 108, 108'. The upper surface 118 of the deck 110 cooperates with the walls 114, 114' of the shoulders 108, 108' to form a receiving region 115 or "seat" for receiving the foot 116 of the rail 102. In the embodiment illustrated the upper surface 118 is canted at an angle of about 1.4 degrees relative to the base 106 so that when mounted on the sleeper 104 the tie plate 100 sets the cant of the rail 102. The degree of cant can be set to suit the intended application, but cants in the range of 1 to 3 degrees are most common. As shown, the deck 110 is disposed above and spaced apart from the base 106 to form an intermediate region 120 therebetween which, in the present case, is a tapered region between an underside or lower surface 122 of the deck 110 and an upper surface 124 of the base 106.

Figure 3:
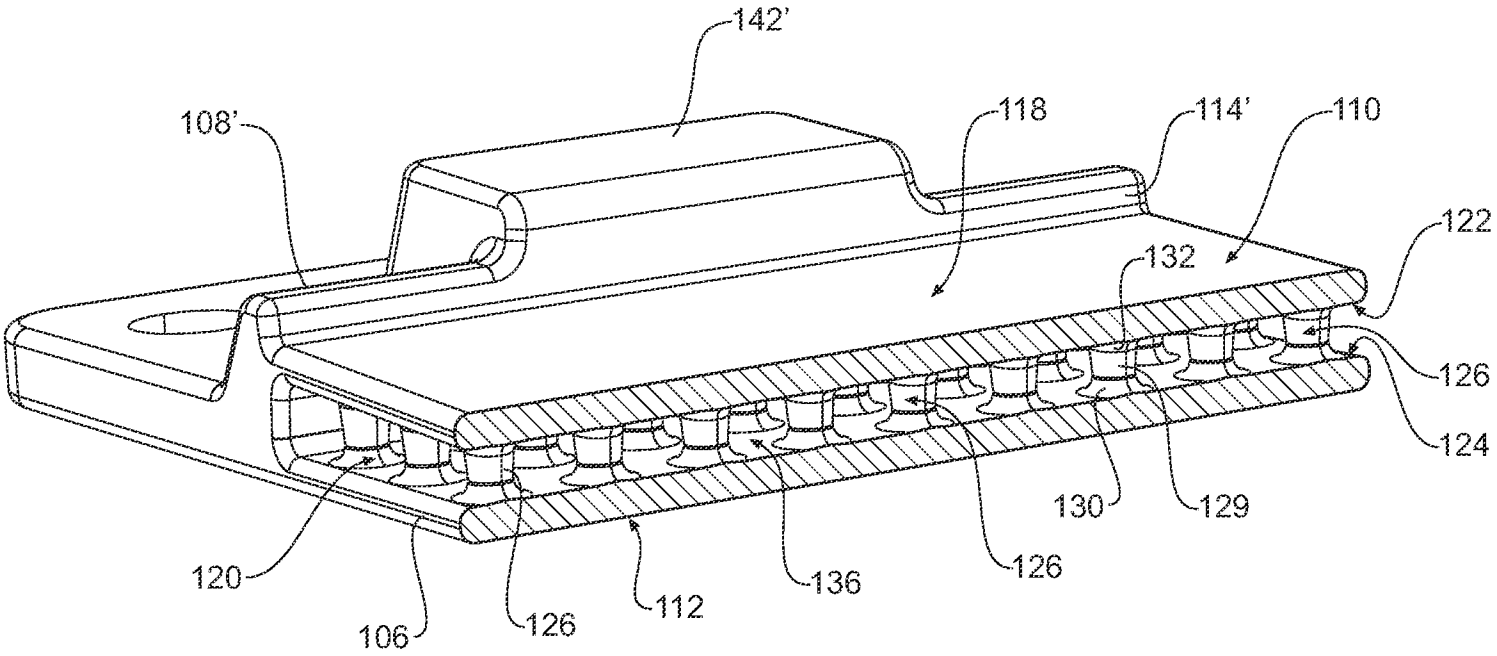
FIG. 3 is a sectional view of the tie plate illustrated in FIG. 1, when sectioned along the line A-A.
Figure 4:
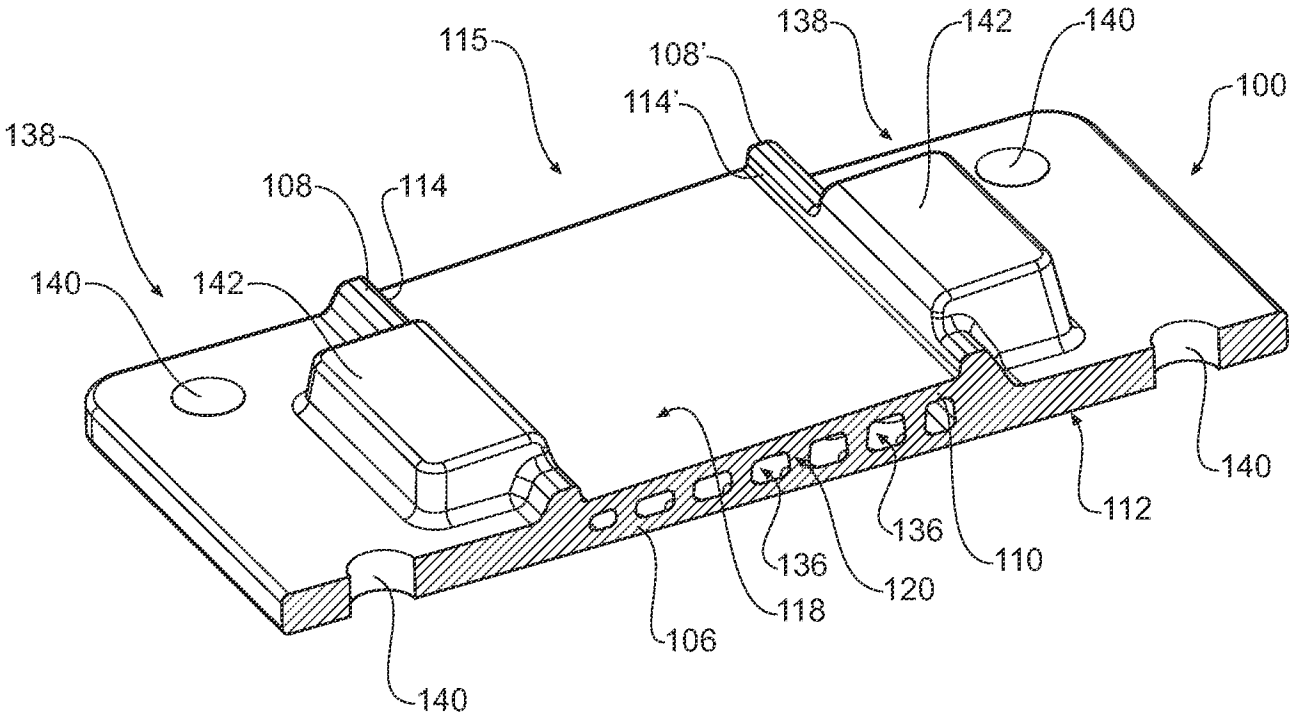
FIG. 4 is a sectional view of the tie plate as illustrated in FIG. 1, when sectioned along the line B-B.
Figure 5:
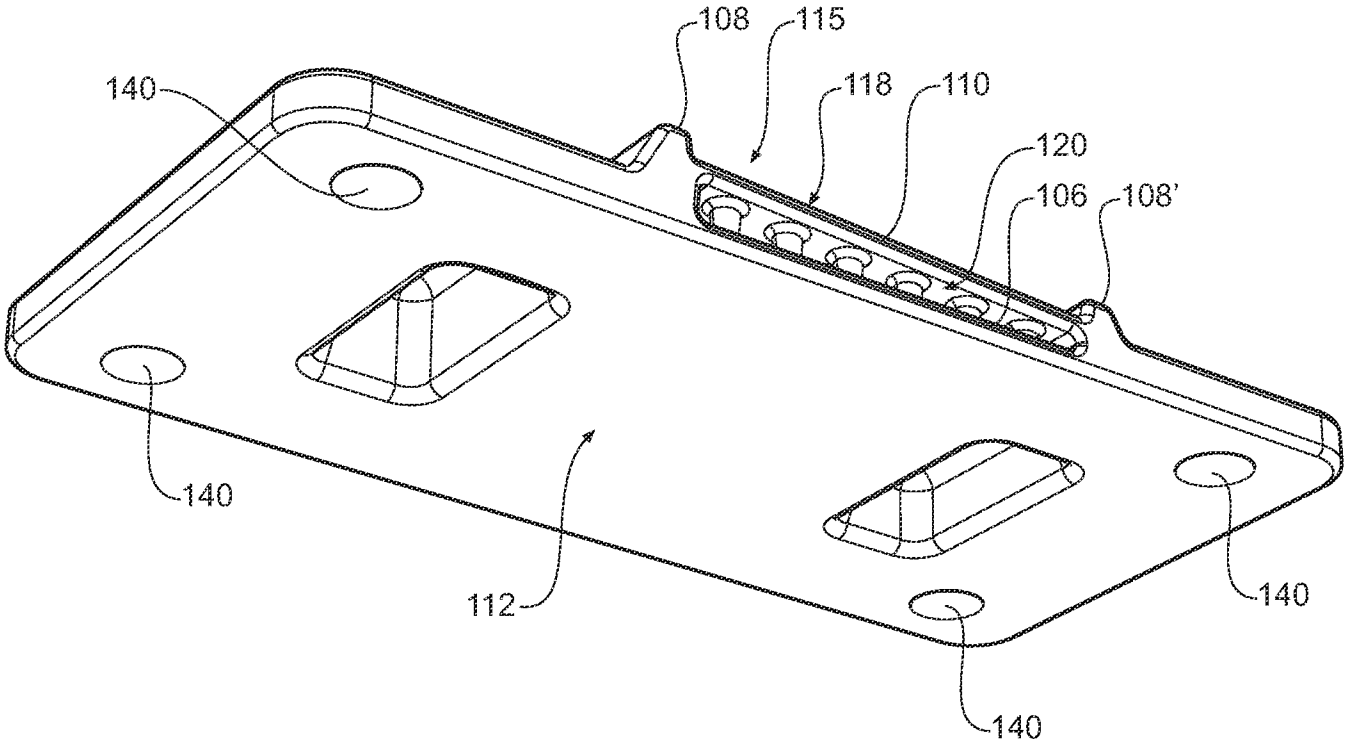
FIG. 5 is bottom view of the tie plate shown in FIG. 1.

As shown in FIG. 3, a plurality of support elements 126 are located within the intermediate region 120. In the illustrated embodiment, the plurality of support elements 126 are integrally formed during manufacture of the tie plate 100. However, in other embodiments one or more support elements 126 may be formed separately and inserted or otherwise located into the intermediate region 120. For example, one or more support elements 126 may be individually or collectively inserted or otherwise located into the intermediate region 120 to support the deck 110. Suitable support elements may include a bar, rail, rib, webbing, pillar, ball, sheet, grid, lattice, beam, rod, or a hollow structure.

Although in the present case the support elements 126 are made from the same material as the deck 110 and the base 106, it is possible that other materials may be used. Examples of suitable materials include a rubber composition, foam, concrete, plastic, a composite material, metal, or an epoxy resin based material. In some embodiments, the material may include a resilient material which is inserted into the intermediate region 120 under compression.

In the present case, the support elements 126 are pillar (or column)-like elements which extend from the base 106 to the deck 110. The pillar-like elements 128 are configured and arranged to support the deck 110 during use. Although in the present case the support elements 126 are illustrated and described as pillar-like elements 128, it will of course be appreciated that other types of support elements may be used, including those referred to above. Other suitable support elements include rib-like elements, struts, webbing or the like. By using suitable support elements 126 within the intermediate region 120, instead of a solid material mass, the weight of the tie plate 100 may be reduced without unduly compromising structural performance.

Figure 2:
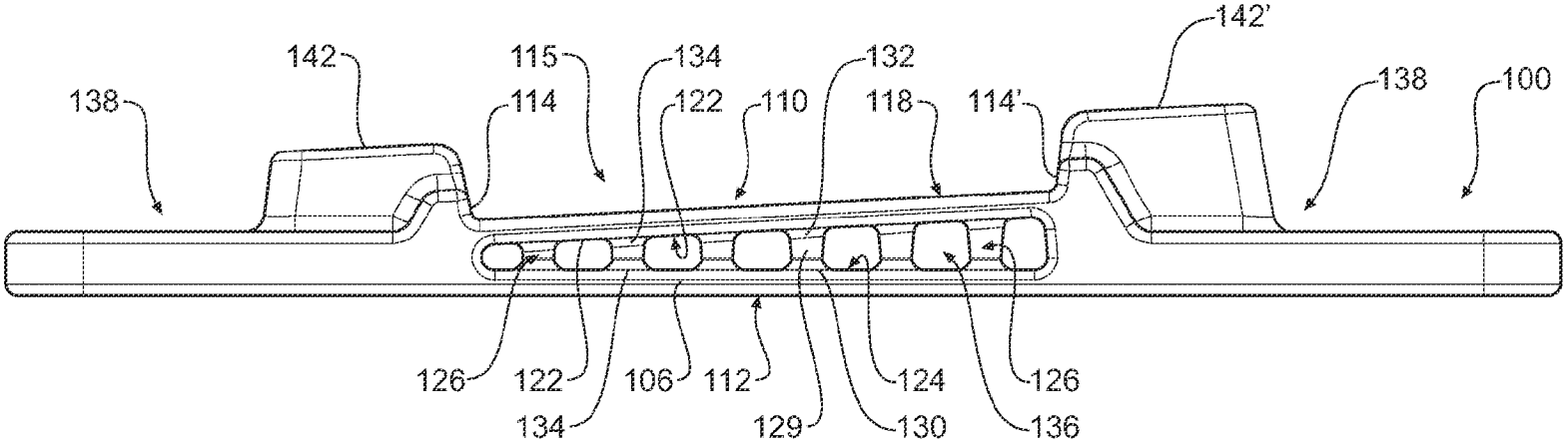
FIG. 2 is an end view of the tie plate illustrated in FIG. 1.

As is more clearly shown in FIGS. 2 and 3, the pillar-like support elements 126 include a generally cylindrical body portion 129. A base 130 and a head 132 are located at a bottom and top end respectively of the body portion 129. The base 130 and the head 132 blend outwardly from the body portion 129 to form fillets 134 extending circumferentially about the cylindrical body portion 129 at the junction with the upper surface 124 of the base 106 and the lower surface 122 of the deck 110 respectively. The fillets 134 reduce stress concentration points and may improve manufacturability.

In the embodiment illustrated the plurality of support elements 126 are arranged in a uniform positional arrangement so that the support elements 126 are substantially equispaced. Furthermore, the plurality of support elements 126 have substantially the same horizontal cross-section. It is not essential that the support elements 126 be arranged in a uniform positional arrangement, nor it is essential that that they have the same cross-section configuration, since other arrangements and configurations may be possible which nonetheless form the interposed region 120 and thus provide the required mechanical characteristics with a weight reduction.

As is shown more clearly in FIGS. 2 and 3, the arrangement of the plurality of support elements 126 forms clearances 136 between the support elements 126. In the present case, together these clearances 136 form a grid-shaped void so that the intermediate region 120 is partially hollow, and therefore the tie plate 100 is lighter than an equivalent solid tie plate. However, in other embodiments it is possible that the clearances 136 may be occupied by one or more additional support elements of a different material to the tie plate 100, such as an insert or filler. Suitable materials may include a rubber composition, plastic, a composite material, metal, foam, concrete, sand or an epoxy resin based material. The filler may provide sound attenuation or assist in keeping water out of the clearances 136 for improved resistance to corrosion.

Including one or more additional support elements within the intermediate region 120 may further reinforce the deck 110 and thus further support the deck 110 during use and thereby further improve the ability of the tie plate 100 to transfer and distribute weight from the rail 102 to the sleeper 104.

The tie plate 100 also includes flanges 138 of a conventional type. As shown, each flange 138 includes a pair of holes 140 for receiving conventional fastening means, such as a nail, bolt, or peg for securing the tie plate 100 to the sleeper 104 in a known manner. It is to be noted that other embodiments of the present invention may not include holes since other embodiments may be secured to a support member using other means, such as a spring clip or the like.

Referring now to FIGS. 6 through 8, the tie plate 100 also includes landings 142 for locating rail retaining means 144, for securing the rail 102 to the tie plate 100. In the present case the landings 142 are illustrated in a simplified representation as mesa-shaped regions. However, it is to be appreciated that other suitable landing configurations may be used. Suitable landing configurations and retaining means for use therewith would be well understood by a skilled addressee.

The landings 142 are adapted to provide a base for anchoring a first end 146 of the rail retaining means 144, so that, in use, a second end 148 of the rail retaining means 144, is biased against the rail 102 to apply a retaining force to the rail foot 116. The retaining force should be sufficient to hold the rail 102 in place on the upper surface 118 of the deck 110 even if the rail 102 should distort during hot weather temperatures. In the present case the rail retaining means 144 are resilient clip-type retainers. However, other suitable rail retaining means would be known to a skilled addressee.

In the embodiment illustrated in FIG. 6, a pad 150 is located between the rail foot 116 and the upper surface 118 of the deck 110. The pad 150 may include, for example, a rubber pad or a polymeric based pad.

The following Figures illustrate additional embodiments of the invention. Since a majority of the features shown in the following Figures are identical to features discussed above, they are denoted by the same reference numerals and will not be described again in detail.

Figure 9:
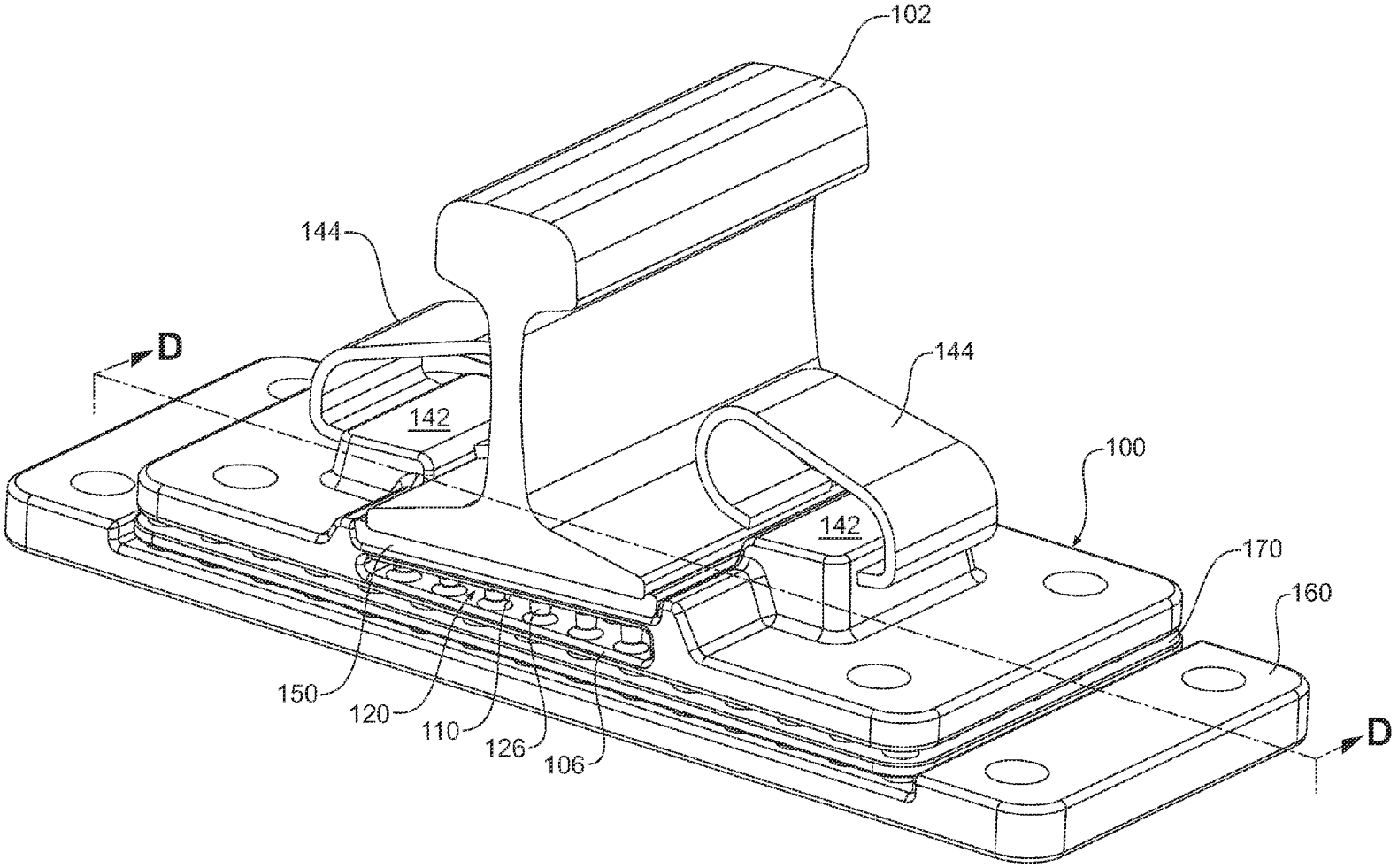
FIG. 9 is a top isometric view of the assembly illustrated in FIG. 6, further comprising additional members supporting the tie plate and rail.
Figure 10:
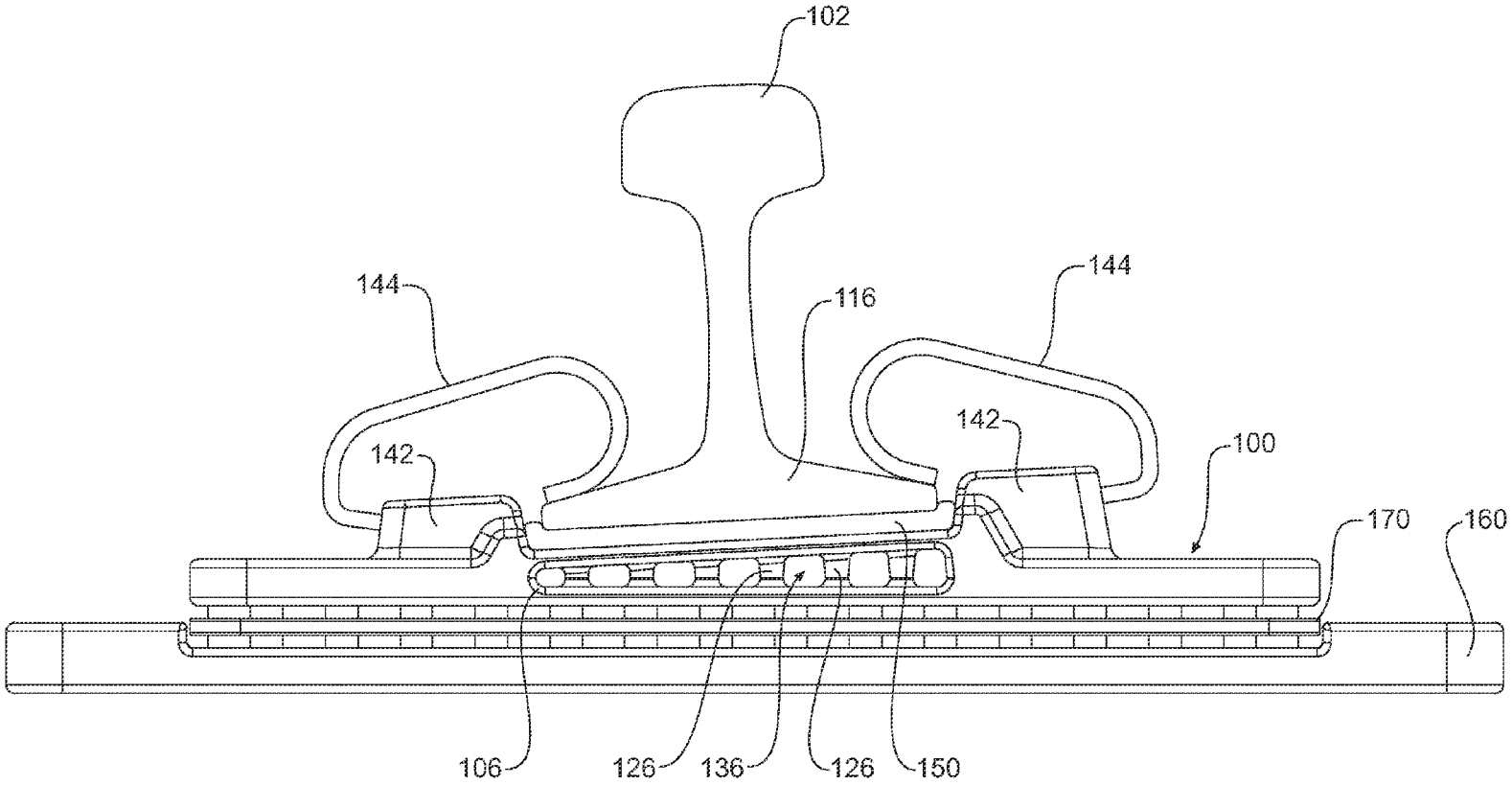
FIG. 10 is an end view of the assembly illustrated in FIG. 9.
Figure 11:
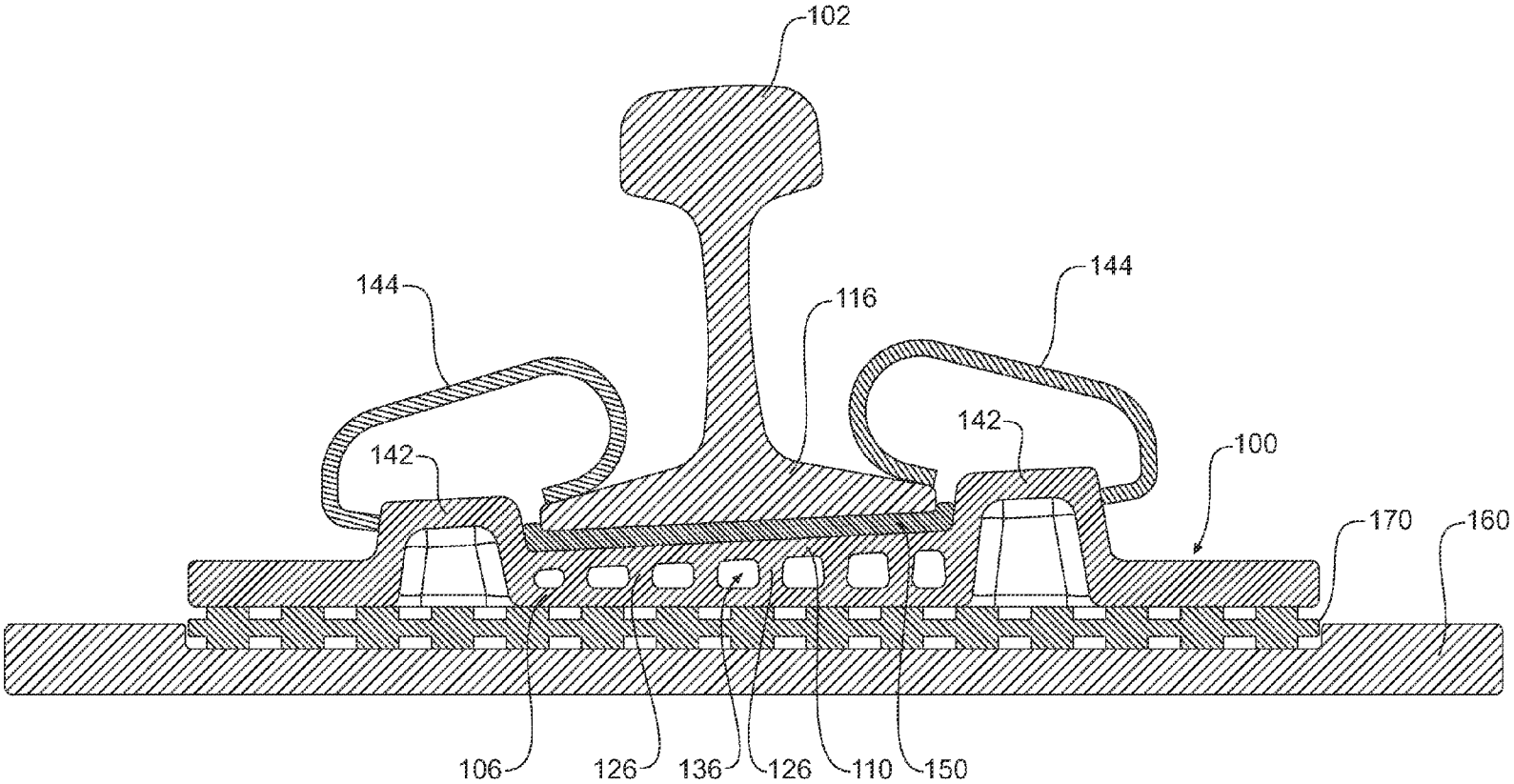
FIG. 11 is a sectional view of the assembly illustrated in FIG. 10, when sectioned along the line D-D.

Referring now to FIGS. 9 through 11, where the assembly discussed above and illustrated in FIGS. 6 through 8 further comprises a base plate 160 for contact with the sleeper (not illustrated in FIGS. 9 through 11), and a sheet of noise attenuating material 170 interposing the base plate 160 and the tie plate.

Whilst the base plate 160 illustrated is solid (see FIG. 11), it could be produced with a lightening (ie. weight reducing) intermediate region interposing its upper and lower surfaces, in accordance with the inventive concept disclosed herein.

Figure 12:
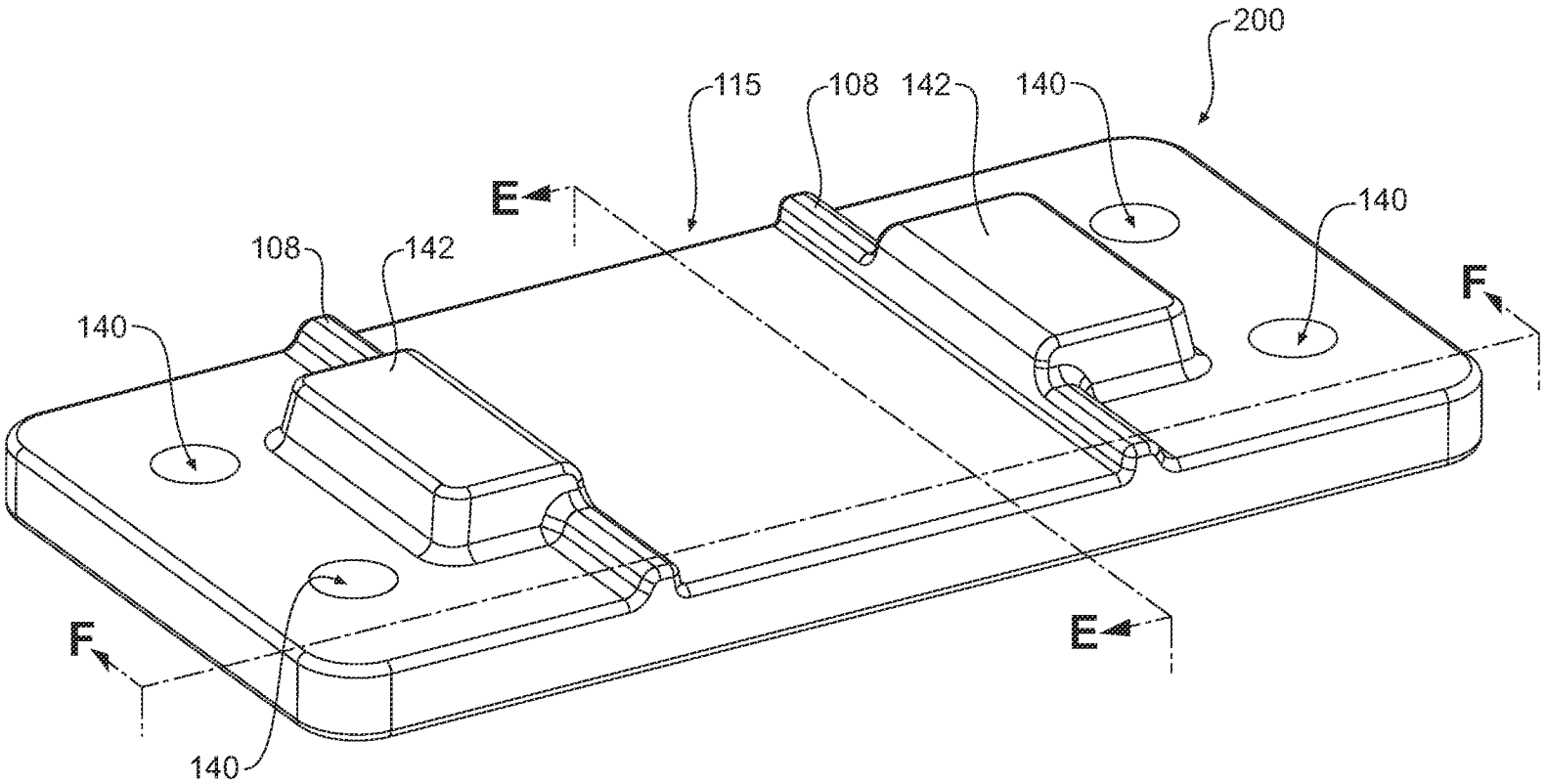
FIG. 12 is a top isometric view of a tie plate according to a first embodiment of the present invention.
Figure 13:
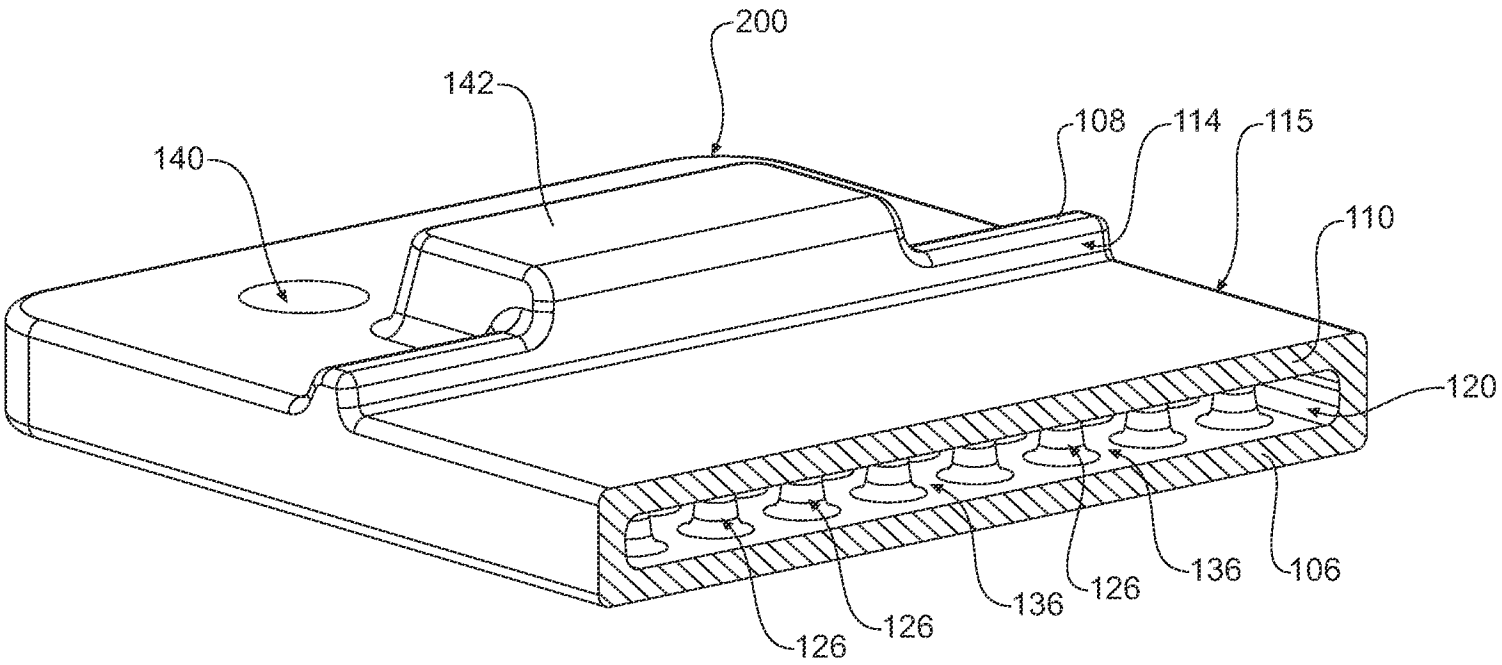
FIG. 13 is a sectional view of the tie plate illustrated in FIG. 12, when sectioned along the line E-E.
Figure 14:
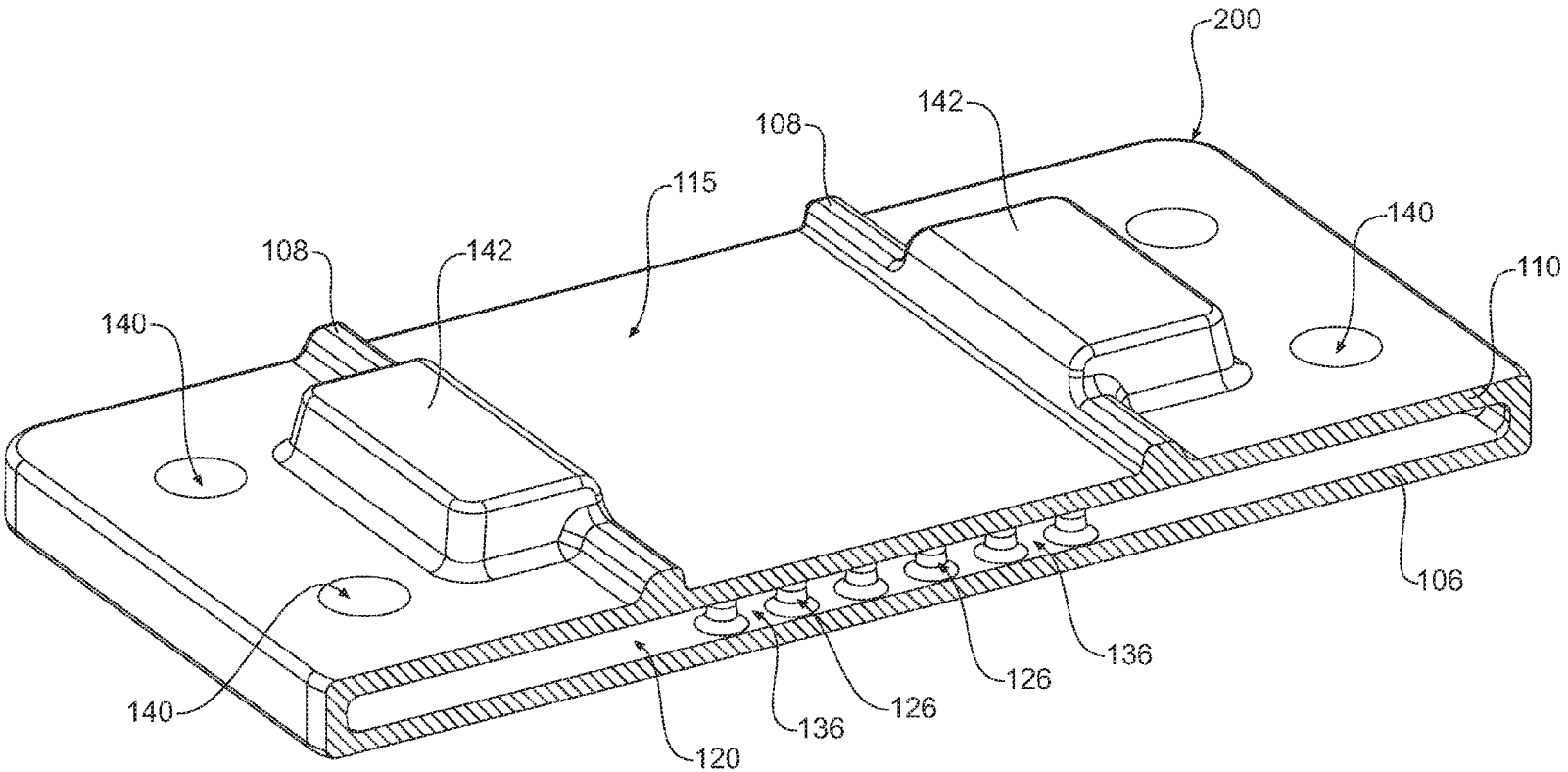
FIG. 14 is a sectional view of the tie plate illustrated in FIG. 12, when sectioned along the line F-F.

Referring now to FIGS. 12 through 14, where there is illustrated a tie plate 200 according to a further embodiment of the invention disclosed herein. Structurally tie plate 200 shares a great deal of similarity with tie plate 100, but differs in two key respects.

Firstly, the intermediate region 120 of tie plate 200 is concealed by way of being substantially enclosed by the tie plate 200. As a result, the intermediate region 120 of tie plate 200 is not visible in FIG. 12, but is visible in the sectional views provided in FIGS. 13 and 14. As discussed previously, this intermediate region 120 may be concealed "as-cast", or it may be concealed by way of a further manufacturing process, such as by welding a cover plate over any opening to the intermediate region 120.

Secondly, and as best illustrated in FIG. 14, the intermediate region 120 of tie plate 200 is so extensive as to largely render tie plate 200 a shell for the intermediate region 120. A plurality of support elements 126 extend between the base 106 and the deck 110 in a region below a receiving region 115 or "seat" for receiving the foot 116 of the rail 102, but otherwise tie plate 200 is substantially hollow, although alternatively it may be filled with a dissimilar material to that from which the tie plate 200 is formed. For example, where tie plate 200 is manufactured using a casting process, tie plate 200 can be produced with a concealed intermediate region 120 'as-cast", by leaving the core (not illustrated) which defines the intermediate region 120 during the casting process, in situ. This would still result in a tie plate 200 which is significantly lighter than an equivalent solid cast iron tie plate.

It will be appreciated by one of ordinary skill in the art in view of the disclosure provided herein that the invention can be utilized in various railway configurations. For example, the invention can be utilized in connection with different types of support members, such as concrete sleepers, timber sleepers, or plastic sleepers, or indeed other types of rail support members such as a concrete slab or the like.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A support plate for supporting a railway rail on a rail support member, said support plate comprising a base comprising a lower surface via which the support plate is supported on a mounting surface of the rail support member, a deck disposed above the base and comprising an upper surface for supporting the rail and at least one shoulder for locating a foot of the rail, and an intermediate region interposing and separating the base and the deck, wherein the intermediate region comprises a plurality of spaced apart columns, each of which extends from the base to the deck, for supporting the deck, wherein the base, the deck and the columns are made from a rigid material, and the intermediate region further comprises clearances that reduce support plate weight.

2. The support plate claim 1, wherein the clearances form a void, so that the intermediate region comprises a hollow region.

3. The support plate of claim 2, wherein the void is grid-shaped.

4. The support plate according to claim 1, wherein the clearances in the intermediate region are at least partially occupied by a further material having different material properties to the deck and the base.

5. The support plate of claim 4, wherein the further material forms a layer between the deck and the base.

6. The support plate according to claim 4, wherein the further material includes at least one of:

a. a rubber composition;
b. plastic;
c. a composite material;
d. metal;
e. concrete;
f. foam;
g. an epoxy resin based material;
h. Sand.

7. The support plate as in claim 1, wherein each column has substantially the same horizontal cross-section.

8. The support plate as in claim 1, wherein each column comprises a generally cylindrical body.

9. The support plate as in claim 1, wherein the columns are disposed in a substantially uniform arrangement.

10. The support plate as in claim 1, wherein the support plate is of cast construction.

11. The support plate as in claim 1, wherein the support plate is of fabricated construction.

12. The support plate as in claim 1, wherein the intermediate region is substantially concealed.

13. The support plate as in claim 1, wherein the support plate is one of an assembly of plates supporting a rail on a rail support member.

14. The support plate of claim 13, wherein the support plate is a lowermost or base plate of the assembly.

15. The support plate as in claim 1, wherein the support plate is a tie plate.

16. The support plate as in claim 1, wherein the support plate is a turn out plate.

17. The support plate as in claim 1, wherein the material of the support plate is made from a metal.

18. The support plate of claim 1, wherein the base, the deck and the columns are made from the same rigid material.

19. The support plate of claim 1, wherein the columns are arranged into a plurality of rows.

20. The support plate of claim 1, wherein the columns are disposed in a non-uniform arrangement.

21. The support plate of claim 1, wherein the columns are spaced throughout the intermediate region.

* * * * *